US010801703B2

(12) United States Patent
Melzner

(10) Patent No.: US 10,801,703 B2
(45) Date of Patent: Oct. 13, 2020

(54) ADJUSTABLE CARRIER STRUCTURE FOR A LAMP AND ALSO A LAMP

(71) Applicant: ARNOLD & RICHTER CINE TECHNIK GMBH & CO. BETRIEBS KG, Munich (DE)

(72) Inventor: Erwin Melzner, Frasdorf (DE)

(73) Assignee: ARNOLD & RICHTER CINE TECHNIK GMBH & CO. BETRIEBS KG, Munich (DE)

( * ) Notice: Subject to any disclaimer, the term of this patent is extended or adjusted under 35 U.S.C. 154(b) by 0 days.

(21) Appl. No.: 16/455,619

(22) Filed: Jun. 27, 2019

(65) Prior Publication Data

US 2020/0003399 A1 Jan. 2, 2020

(30) Foreign Application Priority Data

Jun. 27, 2018 (DE) ..... 10 2018 115 419

(51) Int. Cl.
*F21V 17/02* (2006.01)
*F21V 14/06* (2006.01)
(Continued)

(52) U.S. Cl.
CPC ..... *F21V 17/02* (2013.01); *F21V 14/06* (2013.01); *F21V 17/04* (2013.01); *F21V 14/04* (2013.01);
(Continued)

(58) Field of Classification Search
CPC ..... F21V 14/04; F21V 14/045; F21V 14/08; F21V 14/085; F21V 17/02; F21V 17/04; F21V 17/06
See application file for complete search history.

(56) References Cited

U.S. PATENT DOCUMENTS 1,691,475 A 11/1928 Hall
5,029,992 A * 7/1991 Richardson ..... G02B 7/10 353/101
(Continued)

FOREIGN PATENT DOCUMENTS

DE 2757614 A1 6/1979
DE 2831461 A1 2/1980
(Continued)

OTHER PUBLICATIONS

EP Office Action in Application No. 19170807.2 dated Nov. 8, 2019.
(Continued)

*Primary Examiner* — Alexander K Garlen
*Assistant Examiner* — Colin J Cattanach
(74) *Attorney, Agent, or Firm* — Maschoff Brennan

(57) ABSTRACT

An adjustable carrier structure for a lamp is described. Said adjustable carrier structure comprises an optical component carrier on which an optical component may be fastened, a coupling device for fastening the carrier structure on the lamp, and at least one threaded spindle. The latter comprises a first threaded spindle end that is mounted in an axially-fixed and non-rotatable manner on the optical component carrier, and is connected to the coupling device via a threaded socket that cooperates with the threaded spindle. In this case, the threaded socket is connected to the coupling device in an axially-fixed and rotatable manner. The threaded spindle extends essentially parallel to an optical axis of the adjustable carrier structure. A distance may be set between the first threaded spindle end and the coupling device by means of rotating the threaded socket. Moreover, a lamp having a carrier structure of this type is proposed.

11 Claims, 3 Drawing Sheets

(51) Int. Cl.

| | |
|---|---|
| ***F21V 17/04*** | (2006.01) |
| ***F21W 131/406*** | (2006.01) |
| ***F21V 14/08*** | (2006.01) |
| ***F21V 14/04*** | (2006.01) |
| ***F21V 17/06*** | (2006.01) |

(52) U.S. Cl.

CPC ..... *F21V 14/045* (2013.01); *F21V 14/065* (2013.01); *F21V 14/08* (2013.01); *F21V 14/085* (2013.01); *F21V 17/06* (2013.01); *F21W 2131/406* (2013.01)

(56) References Cited

U.S. PATENT DOCUMENTS

| | | | | |
|---|---|---|---|---|
| 6,092,914 | A * | 7/2000 | Esakoff | F21V 14/06 362/268 |
| 9,182,106 | B2 * | 11/2015 | Melzner | F21V 14/06 |
| 10,495,802 | B2 * | 12/2019 | Jurik | F21V 3/00 |
| 2002/0060911 | A1 * | 5/2002 | Brockmann | F21V 17/02 362/321 |
| 2004/0017685 | A1 * | 1/2004 | Dedoro | F21V 5/045 362/268 |
| 2005/0286250 | A1 * | 12/2005 | Tanaka | F21V 14/06 362/319 |
| 2006/0133079 | A1 * | 6/2006 | Callahan | E04C 3/08 362/242 |
| 2009/0122549 | A1 * | 5/2009 | Hou | F21V 5/04 362/282 |
| 2011/0080735 | A1 * | 4/2011 | Quadri | F21V 11/06 362/277 |
| 2011/0103063 | A1 * | 5/2011 | Jurik | F21V 5/045 362/285 |
| 2012/0127710 | A1 * | 5/2012 | Jurik | F21V 5/008 362/235 |
| 2013/0170222 | A1 * | 7/2013 | Lin | F21V 14/06 362/309 |
| 2014/0233244 | A1 * | 8/2014 | Jurik | F21V 17/02 362/319 |
| 2014/0301071 | A1 * | 10/2014 | Jorgensen | F21V 14/06 362/231 |
| 2014/0313744 | A1 | 10/2014 | Collias | |
| 2016/0047533 | A1 * | 2/2016 | Jurik | F21V 14/06 362/332 |
| 2016/0238217 | A1 * | 8/2016 | Latteo | F21S 10/026 |
| 2016/0245490 | A1 * | 8/2016 | Jurik | F21V 21/30 |
| 2016/0298829 | A1 * | 10/2016 | Jurik | F21V 14/02 |
| 2017/0074497 | A1 * | 3/2017 | Jurik | F21V 21/15 |
| 2017/0090115 | A1 | 3/2017 | Jurik et al. | |
| 2017/0269292 | A1 * | 9/2017 | Jurik | F21V 3/00 |
| 2018/0313521 | A1 * | 11/2018 | Jurik | F21V 17/02 |
| 2018/0347788 | A1 * | 12/2018 | Vilem | G02B 15/173 |
| 2019/0093860 | A1 * | 3/2019 | Peard | F21V 5/007 |

FOREIGN PATENT DOCUMENTS

| | | | |
|---|---|---|---|
| DE | 20 2005 001 704 U1 | 6/2005 | |
| DE | 10 2005 044 237 A1 | 3/2007 | |
| DE | 202013007715 U1 * | 12/2014 | F21V 14/06 |

OTHER PUBLICATIONS

DE Office Action in application No. 10 2018 115 419.4 dated Jan. 21, 2019.

EP Office Action in Application No. 19 170 807.2 dated Jul. 31, 2020.

* cited by examiner

ADJUSTABLE CARRIER STRUCTURE FOR A LAMP AND ALSO A LAMP

This specification claims priority of DE 10 2018 115 419.4 filed on 27 Jun. 2018, the disclosure of which is incorporated herein in its entirety.

TECHNICAL FIELD

The present specification relates to embodiments of an adjustable carrier structure for a lamp. The specification likewise relates to a lamp for illuminating a film environment, studio environment, stage environment, event environment and/or theatre environment. In particular, the adjustable carrier structure is embodied for setting a light emitting angle of the lamp.

BACKGROUND

Lamps are typically used to illuminate a film environment, studio environment, stage environment, event environment and/or theatre environment. Occasionally it is desirable for different types of illumination to be able to be performed using a single lamp. In this context, a lamp may render possible, for example, a setting in which the light is pointedly oriented toward a circular or elliptical surface. In this setting, a transition between the illuminated surface and the surfaces surrounding said illuminated surface is clearly visible. Alternatively, a lamp may also be set in such a manner that a comparatively large surface is illuminated and the light field gently blends into the surrounding area.

For this purpose, it is known to fit lamps with (Fresnel) lenses that may be displaced relative to a light source of the lamp along an optical axis. A large adjustment range of the lamp in this case implies a large adjustment travel of the lens along the optical axis. This leads to the fact that lamps of this type comprise a large installation length along the optical axis. The lamp housing, which is also referred to as a lens barrel, is therefore relatively large. In particular, the lamp housing must be as long as the focus travel requires and must comprise a diameter that renders it possible to receive the (Fresnel) lens in the lamp housing. Moreover, the lighting means and its mounting parts may be received in the lamp housing. In addition, in one setting in which the lens sits comparatively close to a light source, therefore comparatively deep in the lamp housing, the light field that is emitted is cut off by the lamp housing. In this case, this is often also referred to as vignetting. In order to avoid this, the lamp housing would have to comprise a particularly large diameter in relation to the optical axis, as a result of which the required installation space of such a lamp would further increase. However, lamps that are constructed as compactly as possible are typically desirable.

Lamps having (Fresnel) lenses are also known in which the (Fresnel) lens is fixedly mounted on a front side of said lamp, and the light source and where applicable further elements such as a reflector, electrical lines, a cooling body, a fan or similar are moved with respect to the lens within the lamp. This construction in general is widespread, however as a whole it is perceived to be less suitable for lamps that comprise a light source (LED light engine) that includes LEDs. This is because in the case of LED lamps, efficient cooling systems are frequently used for the LED light engine and the procedure of adjusting said cooling systems relative to the (Fresnel) lens is often complex.

As a consequence, a conflict of objectives occurs between a compact construction of a lamp and a large setting range of the light field that is emitted by the lamp.

The object of the present invention is therefore to solve or at least to mitigate this conflict of objectives and to propose a lamp in which a large setting range is combined with a compact construction.

DESCRIPTION

In accordance with an embodiment, an adjustable carrier structure for a lamp is proposed. This carrier structure comprises an optical component carrier on which an optical component may be fastened, a coupling device for fastening the carrier structure to the lamp, and at least one threaded spindle that comprises a first threaded spindle end that is mounted in an axially-fixed and non-rotatable manner on the optical component carrier, and is connected to the coupling device via a threaded socket that cooperates with the threaded spindle, wherein the threaded socket is connected to the coupling device in an axially-fixed and rotatable manner, wherein the threaded spindle extends essentially parallel to an optical axis of the adjustable carrier structure and a distance may be set between the first threaded spindle end and the coupling device by means of rotating the threaded socket. The term "optical components" in this context is also understood to mean, in addition to lenses, for example screens, polarization filters, and colored glass or protective glass. Moreover, the invention is not limited to a lamp with the result that the adjustable carrier structure may also be fastened to other optical components.

It is clear that the adjusting mechanism, which comprises the threaded spindle and the threaded socket, for setting the distance between the first threaded spindle end and the coupling device may also be kinematically reversed. The threaded socket is then connected to the optical component carrier in lieu of to the coupling device.

In accordance with a further embodiment, an adjustable carrier structure for a lamp is proposed, in particular for setting a light emitting angle of the lamp, said carrier structure comprising an optical component carrier, on which an optical component may be fastened for receiving the light that is emitted by the lamp, a coupling device for fastening the carrier structure on the lamp and an adjusting device that is embodied for adjusting the distance between the coupling device and the optical component carrier along an optical axis of the lamp. In the case of this embodiment, the adjusting device may comprise a threaded spindle and/or a toothed rod. It is also conceivable to embody the adjusting device as a hydraulic or pneumatic adjusting device.

Furthermore, a lamp having an adjustable carrier structure of the above-mentioned type is proposed. As used herein, the term "lamp" may likewise refer to a spotlight (in German: "Scheinwerfer").

SHORT DESCRIPTION OF THE DRAWINGS

The parts that are illustrated in the figures are not necessarily to scale; on the contrary the emphasis is on illustrating the principles of the invention. Moreover, identical reference numerals in the figures refer to parts that correspond to one another. In the figures.

DETAILED DESCRIPTION

In the following detailed description, reference is made to the attached drawings that are associated with said description and in which it is illustrated by means of specific embodiments how the invention may be used in practice.

Figure 1:
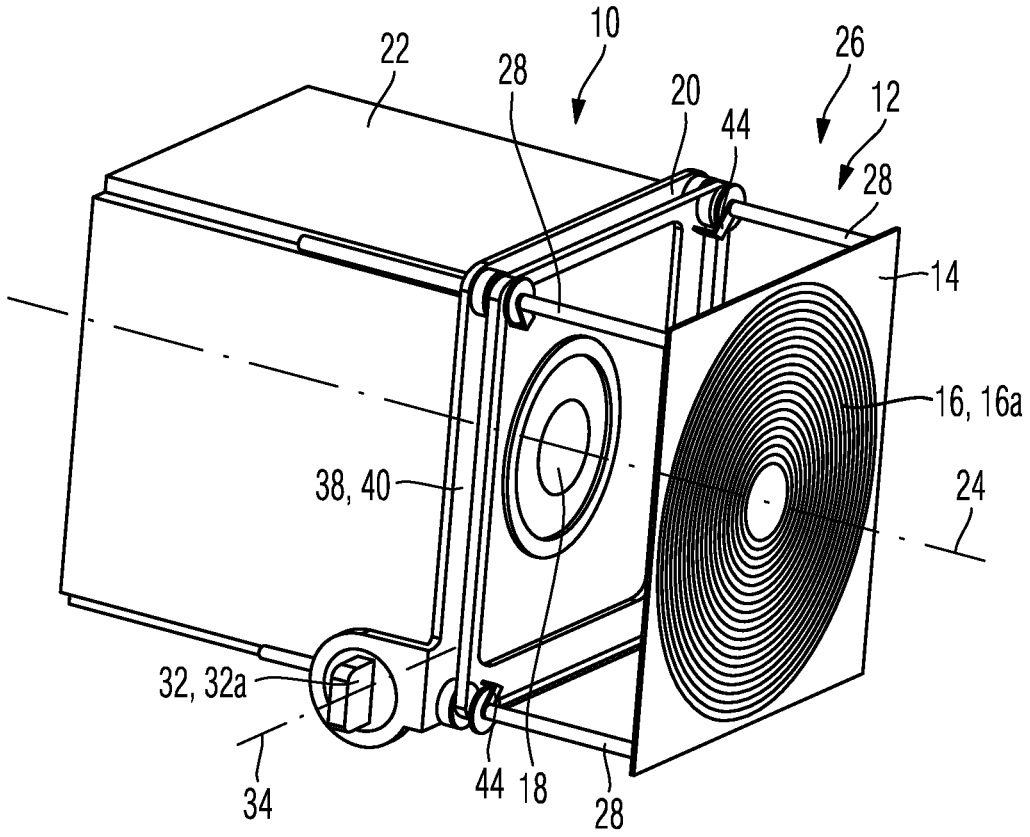
FIG. 1 illustrates schematically and in an exemplary manner a lamp having an adjustable carrier structure in accordance with one or multiple embodiments.

FIG. 1 illustrates a lamp 10 that is fitted with an adjustable carrier structure 12.

The adjustable carrier structure 12 is embodied for setting a light emitting angle of the lamp 10 and comprises for this purpose an optical component carrier 14 on which an optical component 16 is fastened for receiving the light that is emitted by the lamp 10. For this purpose, a light emitting opening 18 is provided.

In the illustrated example, the optical component 16 comprises a lens 16*a*. The optical component carrier 14 may therefore in this case also be referred to as a lens holder or lens carrier. It is clear that in other exemplary embodiments, other optical components 16 may also be fastened to the optical component carrier 14.

The carrier structure 12 is fastened by means of a coupling device 20 on the lamp 10, more precisely on the lamp housing 22 that is also referred to as a lens barrel. In this case, the coupling site of the carrier structure 12 is arranged on the lamp 10 on the light emitting side of said lamp, where the light emitting opening 18 is also provided.

The carrier structure 12 may also be screwed, clamped and/or hooked on the lamp 10 via the coupling device 20. Alternatively, other suitable fastening means are also possible. The procedure of fastening the carrier structure 12 on the lamp 10 may also be performed using tools that correspond to the fastening means or also may be performed without using tools.

A distance along an optical axis 24 between the coupling device 20 and the optical component carrier 14 may be set by means of an adjusting device 26. In this manner, the lamp 10 may be transferred by way of example from a spot setting into a flood setting and conversely.

In the embodiment that is illustrated in the figures, a distance of the lens 16*a* from a lens-side end of the lamp housing 22 is therefore set via the adjusting device 26.

Figure 2:
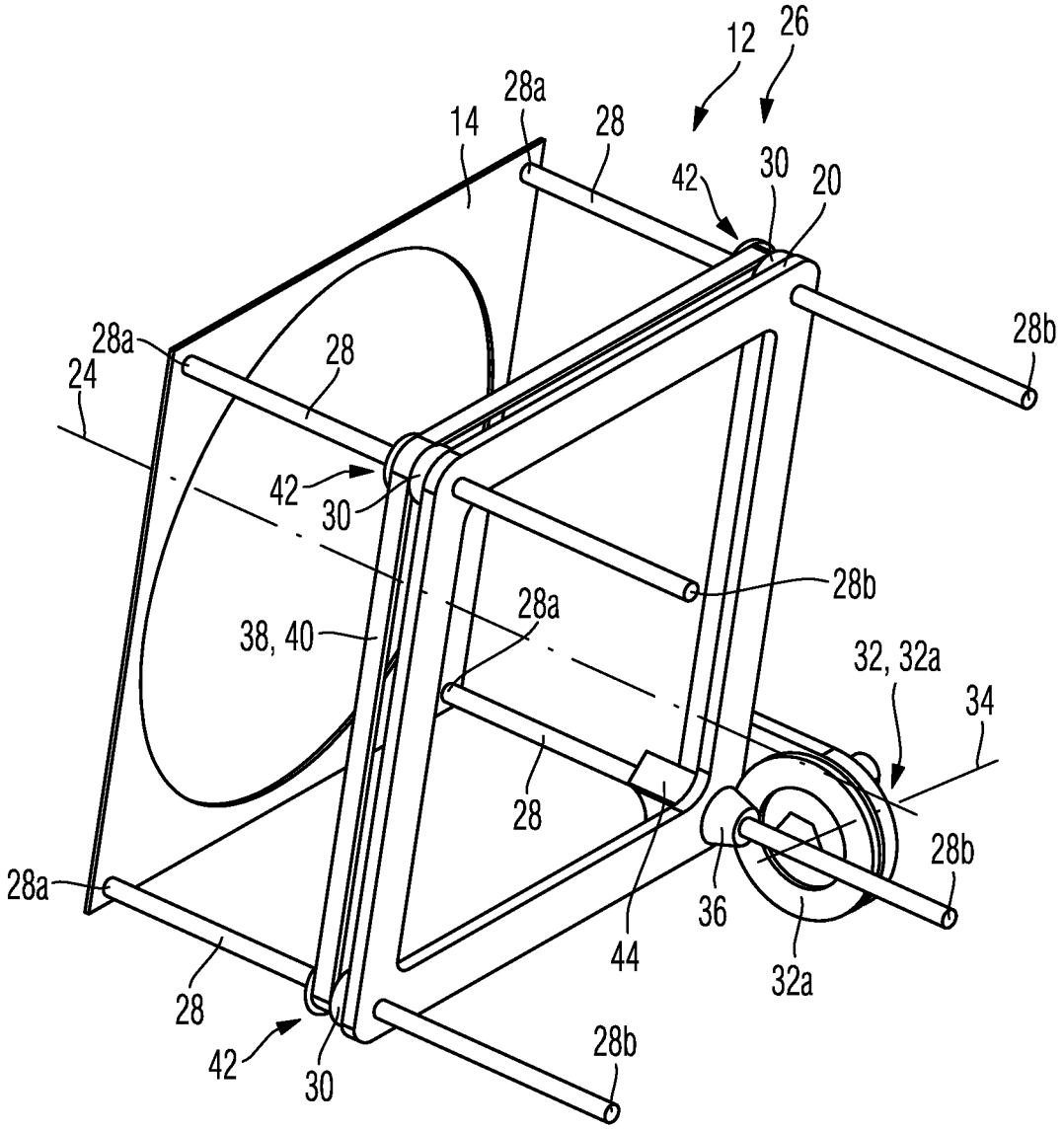
FIG. 2 illustrates schematically and in an exemplary manner the carrier structure in FIG. 1 in a state that is achieved by the lamp, wherein the view perspective is opposite to that in FIG. 1.

For this purpose, the adjusting device 26 in the illustrated example comprises four threaded spindles 28 that comprise respectively a first threaded spindle end 28*a* and a second threaded spindle end 28*b* (cf. FIG. 2). In this case, the first threaded spindle end is mounted in an axially-fixed and non-rotatable manner on the optical component carrier.

The connection of the threaded spindles 28 to the coupling device 20 is provided via respectively allocated threaded sockets 30 that cooperate with the respective threaded spindle 28. These threaded sockets are connected to the coupling device 20 in an axially-fixed and rotatable manner.

All the threaded spindles 28 extend essentially parallel to the optical axis 24.

In addition to the connection of the carrier structure 12 to the lamp housing 22, the coupling device 20 therefore also serves for the mounting and guiding of the threaded rods 28. The coupling device 20 therefore may also be referred to as the base plate.

In this embodiment, the distance between the optical component carrier 14, more precisely the first threaded spindle end 28*a*, and the coupling device 20 may now be set by virtue of the fact that the threaded sockets 30 are rotated with respect to the coupling device 20.

For this purpose, one or multiple of the threaded sockets 30, preferably one single threaded socket 30, is or are coupled to a drive component 32 in such a manner that the threaded socket 30 may be set into rotation relative to the allocated threaded spindle 28.

In the present embodiment, the drive component 32 comprises a rotary knob 32*a* that may be rotated by hand about a rotary knob axis 34. Such a rotary knob may also be referred to as a focus knob.

In alternative embodiments, two focus knobs may also be provided that are arranged on opposite sides of the carrier structure 12.

In alternative embodiments, the drive component 32 may alternatively or additionally comprise an electric motor. Hydraulic and/or pneumatic drive components are also conceivable. Moreover, the drive components may be arranged in an arbitrary position on the carrier structure 12.

The threaded socket 30 that is coupled to the drive component 32 is connected in the illustrated embodiment to a gear wheel 36 in a non-rotatable manner, said gear wheel cooperating with the drive component 32. The drive component 32 comprises for this purpose a toothed section 32*a* that is in engagement with the gear wheel 36.

The toothed section 32*a* and the gear wheel 36 therefore form a transmission that may be embodied as a spur gear or bevel gear.

The second threaded spindle ends 28*b* are arranged in the illustrated embodiment radially outside the lamp in relation to the optical axis 24. As the distance between the optical component carrier 14 and the coupling device 20 or the lamp housing 22 is adjusted, said threaded spindle ends therefore always move outside the same.

For this purpose, groove-shaped depressions or openings, in particular holes, are provided on the lamp housing 22 in which the second threaded spindle ends 28*b* may move during the adjusting procedure along the optical axis 24.

In order to be able to reliably and precisely position the optical component carrier 14, all the threaded sockets 30 are coupled in a rotatable manner to one another via a pulling means 38 that is a toothed belt 40 in the present embodiment.

The toothed belt 40 in this case engages with its teeth in the toothing arrangement 42 that is provided respectively on the outer circumference of the threaded sockets 30.

All the threaded sockets 30 are therefore set into rotation via toothed belts 40 by means of the drive component 32. A V-belt, a chain or any other suitable pulling means may also be used as an alternative to the toothed belt 40.

It is naturally also possible in lieu of coupling all the threaded sockets 30 by means of a single toothed belt 40 to couple the threaded sockets 30 in pairs or groups to a toothed belt. In this case, multiple toothed belts may be necessary in order to set all the threaded sockets 30 into rotation.

In addition to the threaded spindles 28, it is possible to provide one or multiple guiding rods that extend along the optical axis 24 that then represents a guiding axis, said guiding rod/rods comprising a guiding rod end that is mounted in an axially-fixed manner on the optical component carrier 14 and being mounted in a guiding opening that is connected to the coupling device 20 so that said guiding rod end may move axially. The kinematically-reversed case is likewise also conceivable. The guiding rod end is then mounted in an axially-fixed manner on the coupling device 20 and is mounted in a guiding opening that is connected to the optical component carrier 14 so that said guiding rod end may move axially.

It is also possible for some of the threaded spindles 28 to be replaced with such guiding rods. In this case, the guiding rods do not comprise threads and are merely used for the stable guiding of the optical component carrier 14 along the optical axis 24. The guiding rods therefore render possible a movement of the optical component carrier 14 along the optical axis 24. Movements transverse with respect to the optical axis 24 are prevented by means of the guiding rods.

In addition, a guiding element 44 may also be allocated to one or multiple of the threaded spindles 28 and/or one or multiple of the guiding rods. Such a guiding element 44 is connected to the coupling device 20 and is used for the purpose of guiding the respectively allocated threaded spindle 28 or the respectively allocated guiding rod in the direction of the optical axis 24 in a region that is spaced from the coupling device.

Moreover, the guiding element 44 is used for the purpose of holding a respectively allocated threaded socket 30 along the optical axis 24 on the coupling device 20. Consequently, it is ensured via the guiding element 44 that although the threaded socket 30 may rotate relative to the coupling device 20, said threaded socket cannot move along the optical axis 24.

In an alternative embodiment, for this purpose the threaded socket 30 may also be held via a groove that is provided on the threaded socket 30 and a lock washer that engages in said groove may be held on the coupling device 20.

It is clear that exemplary embodiments are also conceivable in which more or less threaded spindles 28 and/or guiding rods are used. However, in accordance with an embodiment at least one threaded spindle 28 is provided. It is preferred that the carrier structure 12 moreover comprises at least one guiding rod on which the optical component carrier 14 slides along the optical axis 24.

As an alternative to a guiding rod, a guiding rail or guiding plate may also be provided on which the optical component carrier 14 slides along the optical axis 24.

In the illustrated exemplary embodiment, the adjusting device 26 comprises four threaded spindles 28. Likewise, alternative embodiments are conceivable in which one or multiple toothed rods are provided in lieu of the threaded spindles 28. The adjusting device may also comprise one or multiple hydraulic cylinders or pneumatic cylinders.

Figure 3:
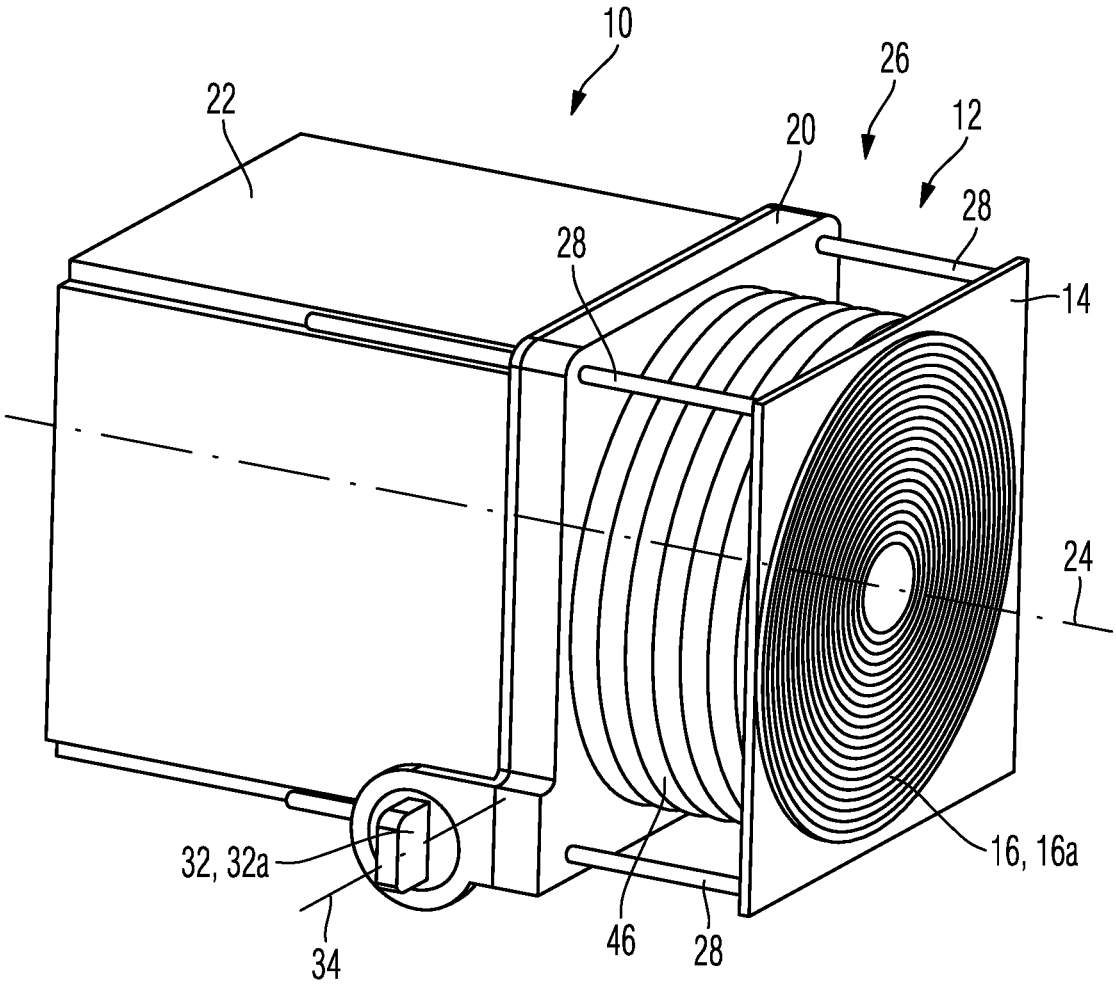
FIG. 3 illustrates schematically and in an exemplary manner a further lamp having an adjustable carrier structure in accordance with one or multiple embodiments.

As is apparent in FIG. 3, the carrier structure 12 may comprise a folding bellows 46 that extends along the optical axis 24 between the coupling device 20 and the optical component carrier 14. In this case, the purpose of the folding bellows 46 is to prevent light being emitted transversely with respect to the optical axis 24 in the region between the coupling device 20 and the optical component carrier 14.

In this case, the folding bellows 46 is fastened both on the coupling device 20 as well as on the optical component carrier 14 in relation to the optical axis 24 in a radial edge region. Reference is to be made here to the fact that the coupling device 20 is covered by means of a housing in the exemplary embodiment that is illustrated in FIG. 3. The housing may encompass for example at least the components 20, 30 and 40 and for example may protect the components against the environment.

In a further-developed embodiment, the optical component carrier 14 may in addition be embodied for the purpose of receiving further lamp components. In particular, the optical component carrier 14 may comprise fastening means via which a leaf door may be fastened on the optical component carrier 14.

The invention claimed is:

1. An adjustable carrier structure for a lamp, having
an optical component carrier on which an optical component may be fastened,
a coupling device for fastening the carrier structure on the lamp, and
a plurality of threaded spindles that are spaced from one another in directions transverse with respect to an optical axis of the adjustable carrier structure and that extend essentially parallel to said optical axis, wherein:
each threaded spindle comprises a first threaded spindle end that is mounted in an axially-fixed and non-rotatable manner on the optical component carrier, and is connected to the coupling device via a threaded socket that cooperates with the threaded spindle, wherein the threaded socket is connected to the coupling device in an axially-fixed and rotatable manner,
a distance may be set between the first threaded spindle end and the coupling device by means of rotating the threaded socket, and
all of the threaded sockets are coupled in a rotatable manner via a pulling means.

2. The carrier structure as claimed in claim 1, wherein the optical component comprises a lens.

3. The carrier structure as claimed in claim 1, further comprising at least one guiding rod that extends along a guiding axis, said guiding rod comprising a guiding rod end, wherein the guiding rod end is mounted in an axially-fixed manner on the optical component carrier and is mounted in a guiding opening that is connected to the coupling device so that said guiding rod end may move axially or wherein the guiding rod end is mounted in an axially-fixed manner on the coupling device and is mounted in a guiding opening that is connected to the optical component carrier so that said guiding rod end may move axially.

4. The carrier structure as claimed in claim 1, wherein each threaded spindle is allocated a guiding element that is connected to the coupling device and guides the respectively allocated threaded spindle in the direction of the optical axis in a region that is spaced from the coupling device.

5. The carrier structure as claimed in claim 1, wherein all the threaded sockets comprise a toothing arrangement on their outer circumference and the pulling means is a toothed belt.

6. The carrier structure as claimed in claim 1, wherein one or multiple of the threaded sockets is or are coupled to a respectively allocated drive component in such a manner that the threaded socket may be set into rotation relative to the allocated threaded spindle.

7. The carrier structure as claimed in claim 6, wherein the drive component comprises an electric motor or a rotary knob that may be actuated manually.

8. The carrier structure as claimed in claim 1, wherein a folding bellows extends along the optical axis between the coupling device and the optical component carrier, wherein the folding bellows is fastened both on the coupling device as well as on the optical component carrier in relation to the optical axis in a radial edge region.

9. A lamp having an adjustable carrier structure as claimed in claim 1.

10. The lamp as claimed in claim 9, wherein the coupling site of the adjustable carrier structure is arranged on a light emitting side of the lamp.

11. The lamp as claimed in claim 9, wherein the ends of the threaded spindles, said ends being remote from the optical component carrier, are arranged radially outside of the lamp in relation to the optical axis.

* * * * *